United States Patent [19]

Kitajima et al.

[11] Patent Number: 5,061,960

[45] Date of Patent: Oct. 29, 1991

[54] PREEXPOSURE LIGHT CONTROL SYSTEM FOR A PHOTOCOPIER

[75] Inventors: Yamato Kitajima, Ramsey, N.J.; Kouji Ito, Osaka, Japan

[73] Assignee: Minolta Camera Kabushiki Kaisha, Osaka, Japan

[21] Appl. No.: 213,771

[22] Filed: Jun. 30, 1988

[30] Foreign Application Priority Data

Jul. 2, 1987 [JP] Japan ..... 62-167577

[51] Int. Cl.[5] ..... G03G 15/04

[52] U.S. Cl. ..... 355/228; 355/68; 355/243

[58] Field of Search ..... 355/68, 214, 228, 235, 355/243

[56] References Cited

U.S. PATENT DOCUMENTS

| | | | |
|---|---|---|---|
| 3,249,007 | 5/1966 | Stauffer | 355/68 X |
| 3,335,636 | 8/1967 | Atkinson | 355/68 X |
| 3,926,518 | 12/1975 | Berry et al. | 355/214 X |
| 4,125,323 | 11/1978 | Ikeda et al. | 355/243 X |
| 4,588,283 | 5/1986 | Tokuhara | 355/214 |
| 4,589,767 | 5/1986 | Yanagi et al. | 355/68 X |
| 4,636,063 | 1/1987 | Takai et al. | 355/228 X |
| 4,673,282 | 6/1987 | Sogame | 355/214 |
| 4,692,019 | 9/1987 | Morimoto et al. | 355/243 X |
| 4,806,989 | 2/1989 | Saito et al. | 355/243 X |
| 4,884,100 | 11/1989 | Kitajima et al. | 355/68 |

*Primary Examiner*—Fred L. Braun

*Attorney, Agent, or Firm*—Price, Gess & Ubell

[57] ABSTRACT

A slit exposure type photocopier apparatus includes an original document platform on which an original document is to be located. An electrostatic latent image support member receives a projected image of the original document as a result of a scanning optical system and an exposure light source. The scanning optical system includes a projection light assembly which is movable along the optical axis in order to change image magnification. A light measuring sensor can be positioned adjacent a side of the projection lens assembly and can measure light reflected from the original at a position displaced, in the forward scan direction, from the actual position on the original that is being projected as a recorded image on the electrostatic latent image support member. The actual displaced position for light measurement will be a function of the image magnification and will be capable of compensating for the lag time involved in changing the exposure output of the exposure lamp.

6 Claims, 2 Drawing Sheets

PREEXPOSURE LIGHT CONTROL SYSTEM FOR A PHOTOCOPIER

FIELD OF THE INVENTION

The present invention generally relates to a copying apparatus and more particularly, to a copying apparatus having an automatic exposure control device.

BACKGROUND OF THE INVENTION

Conventionally, there has been proposed in Japanese Laid Open Patent Application No. 60-256129, a copying apparatus in which an original document on an original document platform made of glass is illuminated by an exposure lamp, and a surface of an electrostatic latent image support member is exposed through a mirror system and a projecting lens assembly by the reflected light. At the side of the projecting lens assembly, there is provided an automatic exposure control device having a directive light quantity detecting device, which is comprised of a photo detector, and a hood for regulating the photo detector to allow the photo detector to receive only the reflected light of the exposure lamp guided through mirror system from the original document. Thus, the density of the original document is measured by detecting the light reflected from the original document, the light quantity of the exposure lamp is controlled according to the density of the original document or condition of colors etc., so as to get a suitable density of a copying image automatically.

However, in the conventional copying apparatus, a second location on the original document from which a light to be measured is reflected coincides with a first location on an original document to be exposed on the light path passing through a center of a projecting lens assembly.

Therefore, the above described apparatus has such a disadvantage that due to the poor response characteristic of an exposure lamp and a time-lag caused by an electric circuit, the result of the detection by the photo detector can not influence the control of a light quantity of the exposure lamp without time-lag.

Consequently, the apparatus has the following disadvantages.

A region of poor image quality is produced on a copy paper, and the width of the region is about 5–6 mm in the direction parallel to the transport direction of a copy paper in the case of equal size magnification. In the case of reduced size magnification, due to the increase of the scanning speed of the exposure lamp, the region is enlarged in inverse proportion to the copying magnification.

SUMMARY OF THE INVENTION

Accordingly, an essential object of the present invention is to provide a copying apparatus in which inconveniences incurred by any of response of an exposure lamp is substantially dissolved, and a light quantity of an exposure lamp is adjusted according to the density of an original document at the first location.

In accomplishing these and other objects, according to one preferred embodiment of the present invention, there is provided a slit exposure type copying apparatus, comprising an original document platform on which an original document is located, an electrostatic latent image support member, scanning optical means which projects an image of an original document on the electrostatic latent image support member by scanning, including a projecting lens assembly which is movable along its optical axis in order to change magnification, a light measuring sensor which is arranged at a side of the projecting lens assembly, and on a light path of the scanning optical means, such that an image forming condition is automatically adjusted by an output of the light measuring sensor, a location adjusting means which deviates a second location to be measured by the light measuring sensor on an original document in a forward direction from a first location to be projected by the projecting lens assembly on an original document, and which adjusts any distance of deviation according to a magnification.

Other objects and features of the present invention will become apparent by reference to the following description and drawings while the scope of the invention will be pointed out in the appended claims.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
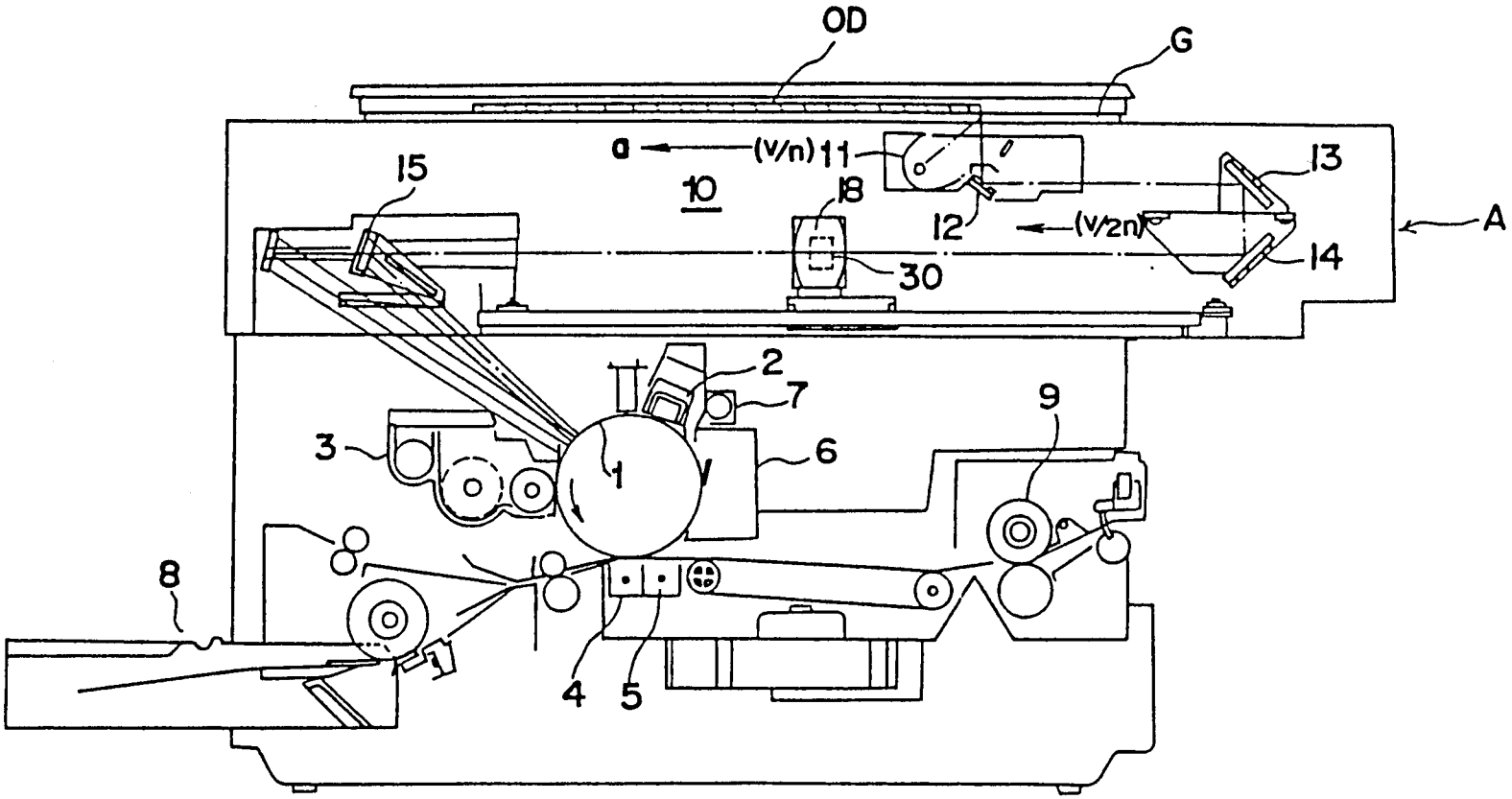
FIG. 1 is a sectional view of a copying apparatus according to one preferred embodiment of the present invention.

Before the description of the present invention proceeds, it is to be noted that like parts are designated by like reference numerals throughout the accompanying drawings.

Referring now to the drawings there is shown in FIG. 1 a copying apparatus A according to one preferred embodiment of the present invention.

The copying apparatus A is of a scanning type having a movable optical system, and in the optical system 10 of this apparatus, a exposure lamp 11 and a first scanning mirror 12 move together to the left in FIG. 1 (in the direction indicated by an arrow a) at a speed V/n(n: copying magnification), a second scanning mirror 13 and a third scanning mirror 14 move likewise to the left in FIG. 1 at a speed V/2n , under a condition in which a photosensitive or a photoreceptive drum 1, provided as an electrostatic latent image support member approximately the center of the apparatus, is rotating in the direct indicated by an arrow.

Reflected light of the light coming from the exposure lamp 11 and illuminating an original document OD on an original document platform G, passes through a projecting lens assembly 18 through the first, second and third scanning mirrors 12, 13, 14, and is exposed on the surface of the photosensitive drum 1 charged uniformly by a corona charger after being reflected by a fourth mirror 15. In this manner, an electrostatic latent image corresponding to an original document image to be copied is formed on the surface of the photosensitive drum 1.

This electrostatic latent image is visualized as a toner image by a developing device 3, and this toner image is transferred on a copy paper which is fed from a paper feed portion 8 in a timed relation with respect to a transfer charger 4.

Thereafter, a copy paper, which is transferred the toner image, is separated from the photosensitive drum 1 by a separating charger 5, and after fixing the toner image by melting the toner on the copy paper by a fixing device 9, the copy paper is discharged into a paper stacking arrangement (not shown). On the other hand, after the toner image is transferred, residual toner is removed from the surface of the photosensitive drum 1 by a cleaning device 6, and residual charge is removed by an eraser lamp 7 so as to prepare for a subsequent copying.

Figure 2:
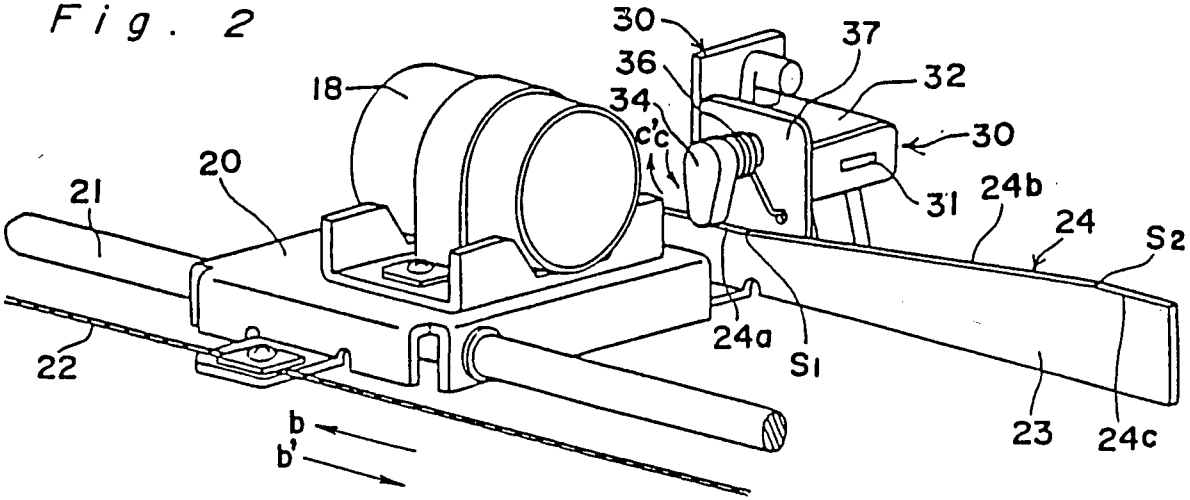
FIG. 2 is a perspective view showing a projecting lens assembly, a light quantity detecting device employed in the arrangement of FIG. 1.
Figure 3:
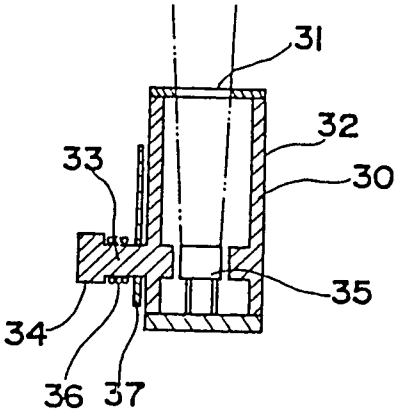
FIG. 3 is a horizontal sectional view of a light quantity detecting device shown in FIG. 2.

In an optical system 10 of the copying apparatus of the above described structure, as shown in FIG. 2, the projecting lens assembly 18 is mounted on a frame 20, which is freely movable along a rail 21 arranged along the direction of the scanning, and is moved in the direction indicated by an arrow b at a reduced size magnification or in the direction indicated by an arrow b′ at an enlarged size magnification according to a copying magnification by a wire 22 driven by a pulse motor, not shown.

On the frame 20, a cam plate 23 having a cam portion 24 on the upper edge is arranged parallel to the rail 21. This cam portion 24 is made of an inclined portion **24*b* which has a predetermined upward slope from position S1 to position S2 along the direction indicated by an arrow b′, a horizontal portion 24*a* located at a side of the cam portion 24 extending in the direction indicated by an arrow b from the point S1, and a horizontal portion 24*c* located at a side of the cam portion 24 extending in the direction indicated by an arrow b′ from the point S2**.

At the side portion of the cam plate 23, a light quantity detecting device 30 of an automatic exposure control device is attached as shown in FIG. 2, 3.

In this light quantity detecting device 30, a slit 31 is formed at the front side (the side facing in the direction indicated by an arrow b′) of the case 32 in the form of box. While, in the rear portion of the case 32, a photo detector 35 is accommodated such that its sensitive surface faces the slit 31, and at one side of the case 32, a lever 34 is provided by means of a support shaft 33. Meanwhile, the photo detector 35 is connected with a control device, not shown, so as to output an electric signal converted from the received light quantity into the control device. The case 32 is also supported rotatably by means of the support shaft 33 on a support plate 37, which is arranged parallel to the side portion of the cam plate 23. The support shaft 33 is wound spirally by a coil spring 36, the both ends of which are fixed respectively to the support plate 37 and lever 34. In this manner, the case 32 and the lever 34 is forced in the direction indicated by an arrow c, and the end of the lever 34 is positioned under a pressed condition on the cam portion 24 of the cam plate 23.

Figure 4:
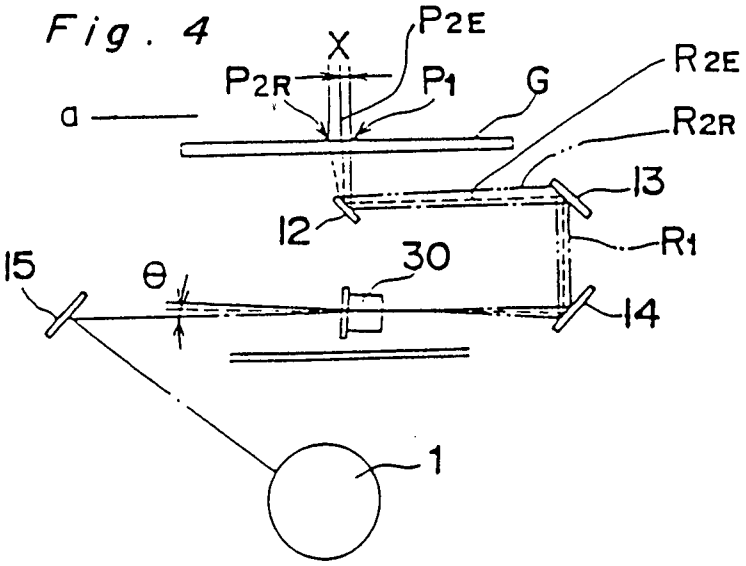
FIG. 4 is a sectional view showing a light path passing through a center of a projecting lens assembly and a light path for measurement in the arrangement of FIG. 1.

More specifically, when the copying magnification is an equal size magnification, the end of the lever 34 is arranged to be pressed against the horizontal portion **24*a* located at a side of the cam portion 24 extending in the direction of an arrow b from position S1, and the photo detector 35 measures a light which comes along a light path R2E from a second location P2E from which a light to be measured is reflected, the light path R2E being at an angle of $\theta$ with a light path R1 passing through a center of the projecting lens assembly 18, and the second location P2E deviating from the first location P1 to be exposed on the light path R1 by a distance X in the direction (the direction indicated by an arrow a) of scanning as shown by dotted line in FIG. 4**.

Accordingly , when the original document OD is illuminated by the exposure lamp 11 by starting the copying operation under the above described conditions, the projecting lens assembly 18 projects an image of the first location P1, and exposes an image on the photosensitive drum 1. On the other hand, the photo detector 35 receives light which is reflected at the second location P2E deviating from the first location P1 by a distance X in the forward direction, and outputs its detected value to the control device, not shown.

In the control device, a density of an original document is detected by receiving a signal output by the photo detector 35, and electric power supplied to the exposure lamp 11 is controlled according to the detected value.

In this case, the exposure lamp 11 responds to the signal output by the control device with a time-lag of itself and the electric circuit. However, the second location P2E to be measured by the photo detector 35 is deviated in front of the first location Pl by a distance X so as to cancel the time-lag of the exposure lamp 11, so that the time-lag is substantially cancelled, and an intensity of light of the exposure lamp 11 is controlled suitably according to the density of an original document at a position approximately equal to the first location P1.

When the copying magnification is a reduced size magnification, the projecting lens assembly 18 and the cam plate 23 move in the direction indicated by an arrow b. As a result, the lever 34 rotates in the direction indicated by an arrow c′ so as to increase the angle $\theta$ and displace the second location in a forward direction from the second location P2E at the time of equal size magnification, making the end of the lever 34 slide along the inclined portion **24*b* between the position S1 and the position S2 on the cam portion 24. For example, when copying magnification is ½, the distance X between the second location P2R and the first location P1** is twice the distance at the time of equal size magnification.

In other words, at the time of reduced size magnification, because the scanning speed of the movable optical system becomes fast and the influence caused by the time-lag of the exposure lamp 11 has a tendency to increase, the distance is extended according to this situation. Therefore, the time-lag of the response of the exposure lamp 11 is substantially canceled, so that a light quantity of the exposure lamp 11 is controlled suitably according to the density of an original document at a position approximately equal to the first location P1.

When copying magnification is an enlarged size magnification, the projecting lens assembly 18 moves in the direction indicated by an arrow b′. As a result, the lever 34 is arranged to be pressed against the horizontal portion **24*a* located at a side of the cam portion 24 extending in the direction of an arrow b from the position S1, and the lever 34 and case 32 maintain the same condition as the condition at the time of equal size magnification. Therefore, the photo detector 35 measures a light coming from the second location P2** deviating by a distance X in forward direction from the first location P1.

Accordingly, when the copying magnification is an enlarged size magnification, the photo detector 35 measures a light coming from the second location P2E, and controls the light quantity of the exposure lamp 11 according to a density of an original document at a position approximately equal to the first location P1, in a same manner at the time of equal size magnification.

Thus, when copying magnification is an enlarged size magnification, so far as the distance at the time of equal size magnification is maintained, the time-lag of the exposure lamp 11 is compensated without reducing the distance according to copying magnification. However, it is more preferable that the second location P2 is displaced close to the first location P1 according to the enlarged size copying magnification.

Meanwhile the present invention is not restricted to the embodiment in which the second location P2 to be measured by the photo detector 30 is adjusted by changing an inclination of the light quantity detecting device 30, but the height of the light quantity detecting device 30 may be adjusted according to copying magnification. In other words, the distance between a light path R2 attaining to the photo detector and a light path R1 passing through the center of the projecting lens assembly 18 may be adjusted with the light path R2 being maintained parallel to the light path R1, so as to adjust the distance X according to copying magnification.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A slit exposure type copying apparatus with an exposure light source, comprising:

an original document platform on which an original document is located;

an electrostatic latent image support member;

scanning optical means which projects an image of an original document exposed by the exposure light source onto the electrostatic latent image support member by scanning the original document from a forward end of the document through a rear end of the document, including a projecting lens assembly which is movable along its optical axis in order to change the magnification of the image;

a light measuring sensor which is arranged adjacent a side of the projecting lens assembly, and on a light path of the scanning optical means to measure light reflected from a location on the original document, such that an image forming condition is automatically adjusted by an output of the light measuring sensor; and a location adjusting means for altering the measurement location of light reflected from the document so that the light measuring sensor measures reflected light from the original document at a position displaced, along the scanning direction, forward from an actual image position on the original document to be projected by the projecting lens assembly onto the electrostatic latent image support member, the amount of forward displacement being a function of the movement of the projection lens assembly to change the magnification of the image, whereby the exposure light source is adjusted prior to projection to the electrostatic latent image support member.

2. An apparatus as claimed in claim 1, in which the location adjusting means adjusts the distance such that the distance at the time of a small magnification is longer than the distance at the time of a large magnification.

3. An apparatus as claimed in claim 2, in which the light measuring sensor is supported rotatably, and an angle of rotation of the light measuring sensor is adjusted by the location adjusting means.

4. An apparatus as claimed in claim 3, in which the location adjusting means has a cam which moves along with the projecting lens assembly, and the light measuring sensor is rotated by the cam when the magnification is changed.

5. In a copying system for reproducing an image of an original on a photoconductive member with an exposure lamp, the improvement comprising:

means for selectively projecting a portion of the original to the photoconductive member during a scanning movement from a forward end of the original through a rear end of the original;

means for measuring the light from the exposure lamp reflected from the original, means for automatically adjusting the light output from the exposure lamp in response to the measuring means, including means for varying the measurement of a point of light from the exposure lamp incident on the original, relative to a point of light to be projected to the photoconductive member, to compensate for the response characteristics of the exposure lamp by changing the measuring position of the point of light incident on the original in a forward direction with respect to the scanning movement, from the point of light from the original to be projected, and means for varying the position of the measuring means in response to variations in the relative magnification ratio of the image and the original so that that the measuring position is relatively adjusted along the scanning direction depending on the magnification ratio, the measuring position being moved forward during enlargement and rearward during reduction relative to a 1:1 ratio position.

6. The copying system of claim 5 wherein the means for varying includes a cam member and a follower member that varies in relationship to movement of the means for selectively projecting.

* * * * *